United States Patent [19]

Yamasaki

[11] Patent Number: 4,818,018

[45] Date of Patent: Apr. 4, 1989

[54] STRETCHABLE LEGLESS CHAIR

[75] Inventor: Yoshikiyo Yamasaki, Osaka, Japan

[73] Assignee: Kabushiki Kaisha Fuji Iryoki, Osaka, Japan

[21] Appl. No.: 892,675

[22] Filed: Aug. 1, 1986

[51] Int. Cl.[4] ..... A47C 3/00

[52] U.S. Cl. ..... 297/284; 272/144; 297/320; 297/340

[58] Field of Search ..... 297/316, 320, 321, 340, 297/343, 19, 29, 284; 5/62, 66, 74, 77; 108/19; 272/144; 128/25 R

[56] References Cited

U.S. PATENT DOCUMENTS

| | | | |
|---|---|---|---|
| 555,859 | 3/1896 | Hall | 5/74 X |
| 2,724,428 | 11/1955 | Sellner | 297/320 |
| 2,994,093 | 8/1961 | Wagner | 272/144 X |
| 3,589,715 | 6/1971 | Mark | 272/144 |
| 4,341,378 | 7/1982 | Agyagos | 272/144 X |
| 4,539,455 | 9/1985 | Colato et al. | 108/19 X |

FOREIGN PATENT DOCUMENTS

| | | | |
|---|---|---|---|
| 1244368 | 9/1960 | France | 297/19 |
| 2514240 | 4/1983 | France | 297/19 |
| 110030 | 8/1979 | Japan | 272/144 |
| 416184 | 9/1934 | United Kingdom | 108/19 |

*Primary Examiner*—Peter A. Aschenbrenner
*Assistant Examiner*—Thomas A. Rendos
*Attorney, Agent, or Firm*—Flynn, Thiel, Boutell & Tanis

[57] ABSTRACT

A stretchable legless chair comprises: a fixed seat frame having a projecting stopper and a holding member provided respectively on the upper surface of the rear portion thereof; a movable seat frame provided over said fixed seat frame and pivotally coupled with the front portion of said fixed seat frame at the front end thereof, and having a chain at the back end thereof to be engaged with said holding member and a leg lever interposed between said fixed seat frame and said movable seat frame and selectibly rotatably mounted on said projecting stopper; a back reclining frame pivotally coupled with the rear end of said movable seat frame at the lower end thereof; and a swinging support lever interposed between said back reclining frame and said fixed seat frame. The stretchable legless chair as described is used as a normal chair, an easy legless chair, an exercise unit for stretching the back of the user.

10 Claims, 2 Drawing Sheets

STRETCHABLE LEGLESS CHAIR

BACKGROUND OF THE INVENTION

1. Field of the Invention

The present invention relates to a stretchable legless chair having a seat portion and a back portion which interlock with each other by movement of weight, thereby enabling the stretching and bending of the spinal column and which is usable ordinarily as an legless chair.

2. Prior Art

Recently, it is a striking tendency for the spinal column to be bent because of the bad posture of children and adults. An apparatus to rectify such bad posture or stretch and bend the spinal column is now in popular in facilities or an ordinary family.

The apparatus as mentioned above, called an exercise unit, have such shortcomings that they need a wide space to accomodate them and much time and labor for fabrication and operation thereof. Inasmuch as these units aim to maintain health, they are not put into a practical use at the present stage other than maintaining a health so these units are difficult to continuously use.

The chair used in general is manufactured only for use in sitting thereon. With such arrangement of a chair, there is a problem of giving pain to those who sit on the chair for a long period of time thereby allowing the spinal column to be crooked due to a load applied to the spinal column.

SUMMARY OF THE INVENTION

It is an object of the present invention to provide a stretchable legless chair having a seat portion a back portion which are interlocking with each other by movement of weight, and a stopper mounted under the seat portion. The stretchable legless chair according to the present invention is ordinarily used as a legless chair but can be used as an exercise unit for stretching and bending a spinal column.

The stretchable legless chair according to the present invention comprises a fixed seat frame having a projecting stopper mounted on an upper surface of the portion close to a rear end thereof, a movable seat frame pivotally coupled with a front portion of the fixed seat frame at the front end portion thereof and having a rotatable leg lever mounted under the movable seat frame, a back reclining frame pivotally coupled with the movable seat frame at the lower end portion thereof, and a swinging support lever interposed between the back reclining frame and the fixed seat frame. A mat material is mounted on the movable seat frame and the back reclining frame.

The above and other objects, features and advantages of the present invention will become more apparent from the following description taken in conjunction with the accompanying drawings.

DESCRIPTION OF THE PREFERRED EMBODIMENT

Figure 1:
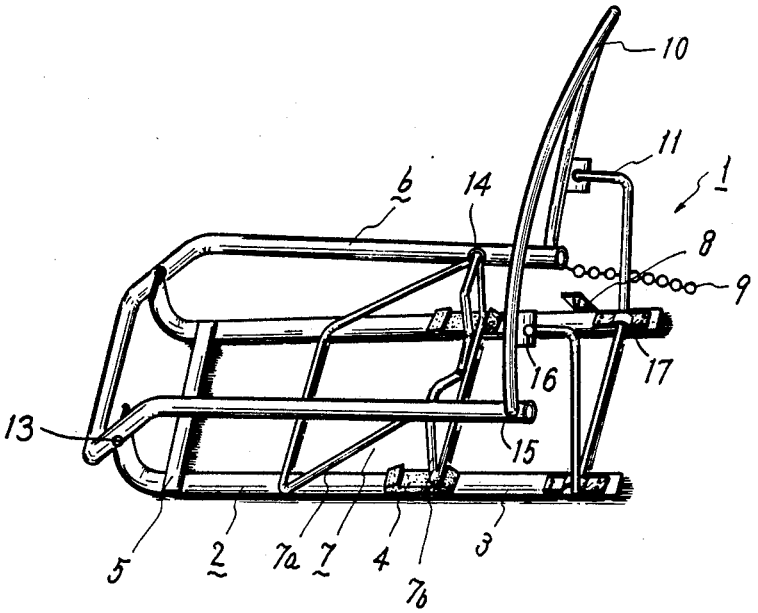
FIG. 1 is a perspective view of a stretchable legless chair according to an embodiment of the present invention.

Designated at 1 is an embodiment of a stretchable legless chair according to the present invention. Designated at 1 is a stretchable legless chair comprising a fixed seat frame 2, a movable seat frame 6 provided over the fixed seat frame and pivotally coupled at 13 with the fixed seat frame 2 at the front end thereof, rotatable leg lever 7 interposed between the fixed seat frame and movable seat frame, and a back reclining frame 10 pivotally coupled with the movable seat frame 6 at the rear end thereof, and a swinging support lever 11 interposed between a location close to the end portion of the back reclining frame 10 and the fixed seat frame 2. A mat material 12 is mounted on the movable seat frame 6 and the back reclining frame 10.

Figure 2:
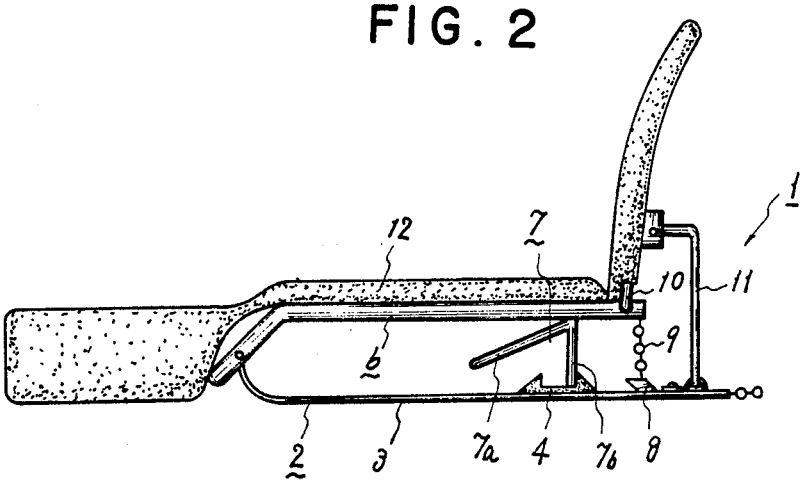
FIG. 2 is a side elevational view of the stretchable legless chair used as a normal legless chair.

The fixed seat frame 2 has an elastic upwardly projecting stopper 4 at the surface of an end thereof, and the front end portion of the fixed seat frame 2 is slightly upwardly curved. The fixed seat frame 2 comprises a pair of elongate rod or tubular support members 3, 3 placed in parallel with each other to thereby support and stabilize the movable seat frame 6. Designated at 5 in the figure is a reinforcing rod mounted between the support members 3, 3, and a holding member 8 is provided at an appropriate position at the rear end of the fixed seat member 2 and is engageable with a chain 9 mounted at the end of the movable seat frame 6 for fixing the movable seat frame 6. The movable seat frame 6 is preferably U-shaped and is provided over the fixed seat frame 2 and pivotally coupled with the fixed seat frame 2 at the front portion thereof so that the movable seat frame 6 is vertically swingable about the fulcrum 13. The movable seat frame 6 further has a leg lever 7 selectively rotatably mounted at 14 on the seat frame 6 for engagement with the projecting stopper 4, and capable of supporting the movable seat frame 6 at a prescribed height. The leg lever 7 comprises long and short rod members which are tubular or plate shaped and bent in U-shape. Both ends of the long leg lever **7*a* and the short leg lever 7*b* are respectively rotatably mounted at 14 to the rear end portion of the movable seat frame. Height between the movable 6 seat frame and the fixed seat frame 2 is adjusted at two stages so that the movable frame is selectively supported by the long leg lever 7*a* (FIG. 3) or the short leg lever 7*b* (FIG. 2). The chain 9 is engageable with the holding member 8 so that the movable seat frame 6 is fixed to the fixed seat frame 2** in either of these illustrated positions.

The back reclining frame 10 is shaped like a rod, tube, or plate, etc. and bent in a reversed U-shaped. The lower end portion of the back reclining frame 10 is pivotally mounted at 15 on the end portion of the movable seat frame 6 so that the back reclining frame 10 is reclinable freely about the pivotal portion is as a fulcrum.

The swinging support lever 11 is made of a rod member or a tubular member or the like which is U-shaped. Upper ends of the swinging support lever 11 are a pivotally coupled at 16 with the back reclining frame 10 at a position slightly upwardly from the lower end portions thereof, and the lower ends of the swinging support lever 11 is rotatably mounted at 17 on the rear end of the fixed seat frame 2 for allowing the swinging support lever 11 to be swingably operated in cooperation with the reclining movement of the back reclining frame 10.

A mat 12 is made of a cushioned type having therein an elastive material such as urethane, polyester, etc. and the mat 12 is mounted on the movable seat frame 6 and the back reclining frame 10 so that an impact load applied to the stretachable legless chair 1 is absorbed when used.

Operation of the stretchable legless chair according to the present invention will be described with reference to FIGS. 2 to 4. When the stretchable legless chair 1 is used as a normal legless chair, the leg lever 7 is rotated to engage the short leg lever 7*b* with the projecting stopper 4 and also engage the chain 9 with the holding member 8 so that the movable seat frame 6 and the back reclining frame 10 are limited in their development without rotating and used as a normal legless chair as shown in FIG. 2.

Figure 3:
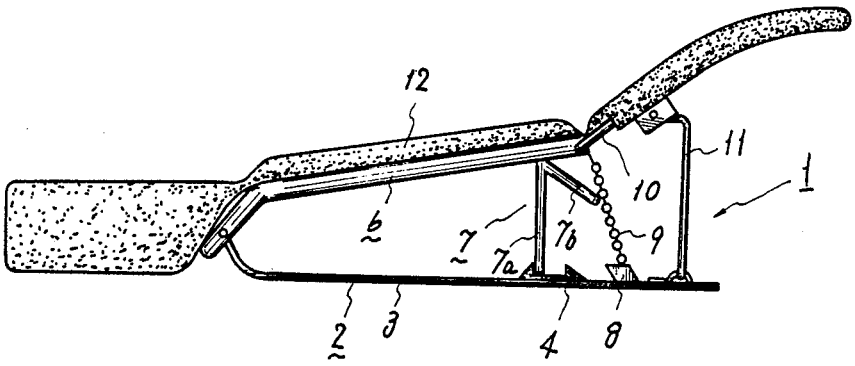
FIG. 3 is a side elevational view of the stretchable legless chair used as an easy legless chair.
Figure 4:
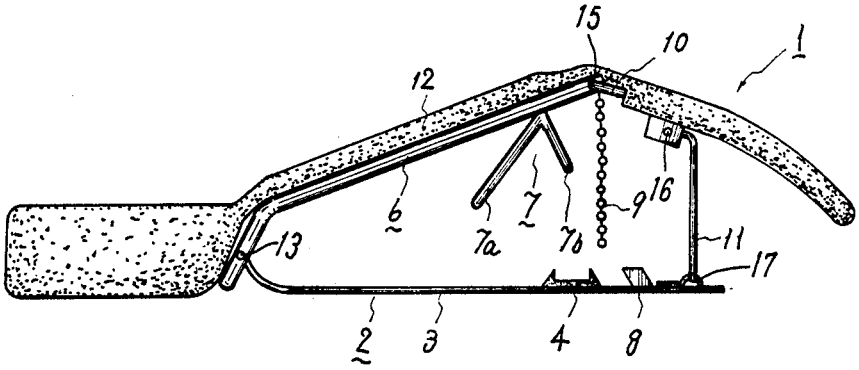
FIG. 4 is a side elevational view of the stretchable legless chair used as an exercise unit for stretching the back.

When the stretchable legless chair 1 is used as a easy legless chair, the long leg lever 7*a* is rotated and engaged with the projecting stopper 4 and the chain 9 is engaged with the holding member 8 as shown in FIG. 3 for thereby allowing the back reclining frame 10 to be reclined so that the stretchable legless chair 1 is used as an easy legless chair.

Further, when the stretchable legless chair 1 is used as an exercise unit for stretching the spinal column, the leg lever 7 is detached from the projecting stopper 4 and the chain 9 is disengaged from the holding member 8 and the user sits on the seat 12 with his legs stretched and with his back in contact with the back reclining frame 10 and bent backward so that weight of the operator is moved from the seat 12 to the back reclining frame 10. With the movement of the weight of the operator, a rear portion of the movable seat frame 6 is lifted and the back reclining frame 10 interlocking with the movable seat frame 6 is reclined downwardly as shown in FIG. 4 with the swinging support lever 11 being swung in response to the reclining of the back reclining frame 10 so that the back of the user is stretched without applying any forcible load. When the user stops reclining his back in the direction of the back reclining frame, the stretchable legless chair is returned to its original position. With repetition of this operation, a desirable stretching exercise is effected.

The stretchable legless chair according to the present invention, as mentioned above, is usable as a normal legless chair, an easy legless chair and an exercise unit for stretching the back of the user. With such an arrangement, the stretchable legless chair according to the present invention overcomes the shortcomings of the conventional chair, meets the needs to to be expected and can be widely utilized and continuously usable.

Although certain preferred embodiment have been shown and described, it should be understood that many changes and modifications may be made therein without departing from the scope of the appended claims.

What is claimed is:

1. A stretchable legless chair comprising:

(a) a fixed seat frame having a projecting stopper and a holding member provided respectively on an upper surface and a rear portion thereof;

(b) a movable seat frame provided over said fixed seat frame and pivotally coupled with a front portion of said fixed seat frame at the front end thereof, and having a chain at the rear end thereof to be engaged with said holding member;

(c) a legged lever interposed between said fixed seat frame and said movable seat frame and selectably rotatably positionable on said projecting stopper, said legged lever having a short leg lever and a long leg lever of greater length than said short leg lever;

(d) a back reclining frame pivotally coupled at a lower end thereof with the rear end of said movable seat frame; and (e) a swinging support lever interposed between said back reclining frame and said fixed seat frame.

2. A stretchable legless chair according to claim 1, wherein said movable seat frame and said back reclining frame is made of tubular or plate members.

3. A stretchable legless chair according to claim 1, further including mat materials mounted respectively on said movable seat frame and said back reclining frame.

4. A stretchable legless chair according to claim 1, wherein said long leg lever is engaged with said projecting stopper and said chain is engaged with said holding member for thereby allowing said stretchable legless chair to be used an easy chair.

5. A stretchable legless chair according to claim 1, wherein said short leg lever is engaged with said projecting stopper and said chain is engaged with said holding member for thereby allowing said stretchable legless chair to be used as a normal chair.

6. A stretchable legless chair according to claim 1, wherein said legged lever is disengaged from said projecting stopper and said chain is disengaged with said holding member for thereby allowing said stretachable legless chair to be used as an exercise unit.

7. A stretchable legless chair comprising:

(a) a fixed seat frame having a pair of substantially parallel rodlike support members, a holding member provided on said seat frame at a rear portion thereof, and each of said support members having a stopper provided on a rear portion thereof;

(b) a movable seat frame provided over said fixed seat frame, said movable seat frame comprising a U-shaped rodlike member having two legs and a bight, said movable seat frame being pivotally coupled with said fixed seat frame adjacent a front end of said support members and having a fixing member mounted at a back end thereof adapted to be engaged with said holding member, said movable seat frame also having a supporting lever rotatably connected thereto, said supporting lever being interposed between said fixed and movable seat frames and selectably rotatably engageable with said stopper, said supporting lever having long and short lever portions of different lengths which are selectively engageable with said stopper to support said movable seat frame at two different positions relative to said fixed seat frame;

(c) a back reclining frame comprising a U-shaped member having two legs and a bight, said back reclining frame having the two legs thereof pivotally coupled with the two legs of the movable seat frame adjacent the back ends thereof; and (d) a swinging support lever having an upper end and a lower end, said lower end of said swinging support lever being rotatably mounted on the rear portion of the fixed seat frame, and the upper end of said swinging support lever being pivotally connected with the two legs of the back reclining frame at a location spaced upwardly from the free ends of the legs thereof.

8. A stretchable legless chair according to claim 7, further including mat means mounted respectively on said movable seat frame and said back reclining frame.

9. A stretchable legless chair, comprising:

(a) an elongate fixed seat frame having front and rear end portions;

(b) an elongate movable seat frame provided over said fixed seat frame and having generally parallel elongate side legs disposed in sidewardly spaced relation, said elongate side legs having front and rear ends, said movable seat frame in the vicinity of the front ends of said side legs being pivotally coupled to said fixed seat frame adjacent the front portion thereof about a first substantially horizontal pivot axis which extends transversely relative to said frames;

(c) means coacting between said fixed and movable seat frames for selectively maintaining said movable seat frame in either upper or lower positions relative to said fixed seat frame, said means including supporting means mounted on one of said frames and selectively engageable with stopper means mounted on the other of said frames, said supporting means and said stopper means defining two engageable positions which respectively define said upper and lower positions;

(d) a reclining back frame mounted to said movable seat frame and projecting upwardly therefrom when said movable seat frame is in said lower position, said reclining back frame having first and second ends which are respectively upper and lower ends when the movable seat frame is in said lower position, the lower end of said reclining back frame being pivotally connected to said movable seat frame about a second substantially horizontally extending axis which is generally parallel with said first axis, said second axis being disposed adjacent the rear ends of said side legs;

(e) support lever means coacting between said fixed seat frame and said reclining back frame, said support lever means having one thereof pivotally coupled to said fixed seat frame adjacent the rear portion thereof for defining a third substantially horizontal pivot axis, said support lever means having the other end thereof pivotally coupled to said reclining seat frame at a location spaced from the lower end thereof for defining a fourth substantially horizontal pivot axis, said third and fourth axes being substantially parallel with said first and second axes; and (f) releasable holding means coacting between said fixed and movable seat frames for holding these frames in fixed relationship to one another when in either of said lower or upper positions, said holding means being disengaged so that said movable seat frame can be pivotally swung upwardly from said upper position about said first axis so that said second axis moves upwardly to an elevation above said fourth axis so that the reclining back frame inclines downwardly from said second axis.

10. A chair according to claim 9, wherein each said movable seat frame, reclining back frame and supporting lever means is defined by a single U-shaped member.

* * * * *